US008839788B2

(12) United States Patent
Betz et al.

(10) Patent No.: US 8,839,788 B2
(45) Date of Patent: Sep. 23, 2014

(54) RESPIRATOR ATTACHMENT COMPONENT WITH MOLDED THERMOSET ELASTOMERIC SEAL

(75) Inventors: James R. Betz, Hudson, WI (US); Sean M. Burke, St. Paul, MN (US); Paul J. Flannigan, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 920 days.

(21) Appl. No.: 12/673,585

(22) PCT Filed: Jul. 23, 2008

(86) PCT No.: PCT/US2008/070808

§ 371 (c)(1), (2), (4) Date: Feb. 16, 2010

(87) PCT Pub. No.: WO2009/029364

PCT Pub. Date: Mar. 5, 2009

(65) Prior Publication Data

US 2011/0100372 A1 May 5, 2011

Related U.S. Application Data

(60) Provisional application No. 60/999,742, filed on Aug. 31, 2007.

(51) Int. Cl.
*A62B 23/02* (2006.01)
*A62B 9/04* (2006.01)

(52) U.S. Cl.
CPC ..... *A62B 9/04* (2013.01)
USPC ..... 128/206.19

(58) Field of Classification Search
USPC ..... 128/206.11–206.29, 205.25
See application file for complete search history.

(56) References Cited

U.S. PATENT DOCUMENTS

| | | | | |
|---|---|---|---|---|
| 4,414,973 | A * | 11/1983 | Matheson et al. | 128/206.15 |
| 4,790,306 | A | 12/1988 | Braun | |
| 4,886,058 | A | 12/1989 | Brostrom et al. | |
| 4,910,806 | A | 3/1990 | Baker | |
| 5,062,421 | A | 11/1991 | Burns | |
| 5,095,936 | A | 3/1992 | Briet et al. | |
| 5,325,892 | A | 7/1994 | Japuntich et al. | |
| 5,456,027 | A | 10/1995 | Tecchio | |
| 5,592,937 | A | 1/1997 | Freund | |
| 5,705,275 | A | 1/1998 | Nakano | |

(Continued)

FOREIGN PATENT DOCUMENTS

| | | |
|---|---|---|
| EP | 0 613 699 | 9/1994 |
| GB | 1360632 | 7/1974 |

(Continued)

OTHER PUBLICATIONS

ShinEtsu Silicone LIMS Selective Self-Adhesive Liquid Silicon Product Brochure, 2001.

(Continued)

*Primary Examiner* — Manuel Mendez
(74) *Attorney, Agent, or Firm* — Craig A. Deutsch

(57) ABSTRACT

Respirator attachment components are described and include a polymeric rigid respirator attachment body portion having a first surface and a second surface and a silicone sealing element chemically bonded to the first or second surface.

18 Claims, 5 Drawing Sheets

(56) References Cited

U.S. PATENT DOCUMENTS

| | | | | |
|---|---|---|---|---|
| 5,720,280 | A | 2/1998 | Elstran et al. | |
| 6,016,804 | A | 1/2000 | Gleason et al. | |
| 6,176,239 | B1 | 1/2001 | Grove et al. | |
| 6,216,693 | B1 | 4/2001 | Rekow | |
| 6,298,849 | B1 | 10/2001 | Scholey | |
| 6,471,820 | B1 * | 10/2002 | Paulick | 156/306.9 |
| 6,629,531 | B2 * | 10/2003 | Gleason et al. | 128/205.25 |
| 6,689,144 | B2 | 2/2004 | Gerberding | |
| 6,843,248 | B2 | 1/2005 | Japuntich et al. | |
| 6,854,463 | B2 | 2/2005 | Japuntich et al. | |
| 7,117,868 | B1 | 10/2006 | Japuntich et al. | |
| 7,849,856 | B2 | 12/2010 | Mittelstadt | |
| 8,136,524 | B2 * | 3/2012 | Ging et al. | 128/206.26 |
| 2001/0035188 | A1 | 11/2001 | Gleason et al. | |
| 2002/0020416 | A1 | 2/2002 | Namey | |
| 2002/0094414 | A1 | 7/2002 | Wagenblast | |
| 2002/0170563 | A1 | 11/2002 | Japuntich et al. | |
| 2002/0185133 | A1 | 12/2002 | Japuntich et al. | |
| 2003/0084902 | A1 | 5/2003 | Japuntich et al. | |
| 2004/0025880 | A1 | 2/2004 | Capon et al. | |
| 2004/0149287 | A1 | 8/2004 | Namey, Jr. | |
| 2005/0109343 | A1 | 5/2005 | Flanningan et al. | |
| 2006/0117469 | A1 | 6/2006 | Garofalo et al. | |
| 2007/0119459 | A1 | 5/2007 | Japuntich et al. | |
| 2008/0133001 | A1 | 6/2008 | Shalev | |
| 2009/0032024 | A1 | 2/2009 | Burz et al. | |

FOREIGN PATENT DOCUMENTS

| | | |
|---|---|---|
| JP | 63-180058 | 11/1988 |
| JP | 2006 289093 | 10/2006 |
| WO | WO 93/24181 | 12/1993 |
| WO | WO 2004/052439 | 6/2004 |
| WO | WO 2005/051490 | 6/2005 |
| WO | WO 2007/009182 | 1/2007 |

OTHER PUBLICATIONS

ShinEtsu LIMS Product Selection Guide, 2007.
Wacker Silicones Elastosil® LR3070 A, B Product Brochure, 2007.

* cited by examiner

RESPIRATOR ATTACHMENT COMPONENT WITH MOLDED THERMOSET ELASTOMERIC SEAL

CROSS REFERENCE TO RELATED APPLICATIONS

This application is a national stage filing under 35 U.S.C. §371 of PCT/US2008/070808, filed Jul. 23, 2008, which claims priority to U.S. Application No. 60/999,742, filed Jul. 23, 2008, the disclosure of which is incorporated by reference in its/their entirety herein.

FIELD

The present disclosure relates to a respirator attachment component and particularly to a respirator attachment component with a molded thermoset elastomeric seal.

BACKGROUND

Respirators provide respiratory protection from airborne substances with filtering processes and/or otherwise facilitating access to clean air. One characteristic of these devices is the seal that is formed between the user and other functional components of the respirator and the seal that is formed between the functional components and structural components of the respirator.

One design consideration with these respirators is the air-tight fastening of an inhalation air source component, an exhalation component and/or speaking diaphragm to the structural component(s) of the respirator. This air-tight seal often requires a separate gasket and/or mechanical seal that adds complexity and cost to the respirator design.

BRIEF SUMMARY

The present disclosure relates to a respirator attachment component and particularly to a respirator attachment component with a molded thermoset elastomeric seal. This disclosure further relates to a respirator that includes a respirator attachment component with a molded thermoset elastomeric seal. This molded thermoset elastomeric seal is chemically bonded to at least one or two surfaces of the respirator attachment component. In many embodiments, the silicone seal element penetrates through at least one aperture of the body of the respirator attachment component.

In a first embodiment, a respirator attachment component includes a polymeric rigid respirator attachment body portion having a first surface and a second surface and a silicone sealing element chemically bonded to the first or second surface. In some embodiments, the silicone sealing element may be chemically bonded to at least two opposing major surfaces of the respirator attachment body portion. The silicone sealing element may in some cases also interpenetrate apertures that extend through the respirator attachment body portion.

In another embodiment, a respirator attachment component includes a polymeric rigid respirator attachment body portion having a first major surface and an opposing second major surface separated by a body portion thickness and a plurality of apertures extending through the polymeric rigid respirator attachment body portion and a silicone sealing element is chemically bonded to the first major surface and second major surface and interpenetrates the apertures.

In a further embodiment, a respiratory protection mask includes a polymeric rigid facepiece body portion and a compliant face contacting member attached to the polymeric rigid facepiece body portion. A respirator attachment component is fixed to the polymeric rigid facepiece body portion. The respirator attachment component includes a polymeric rigid respirator attachment body portion having an attachment surface, and a silicone sealing element chemically bonded to the attachment surface.

BRIEF DESCRIPTION OF THE DRAWINGS

The invention may be more completely understood in consideration of the following detailed description of various embodiments of the invention in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
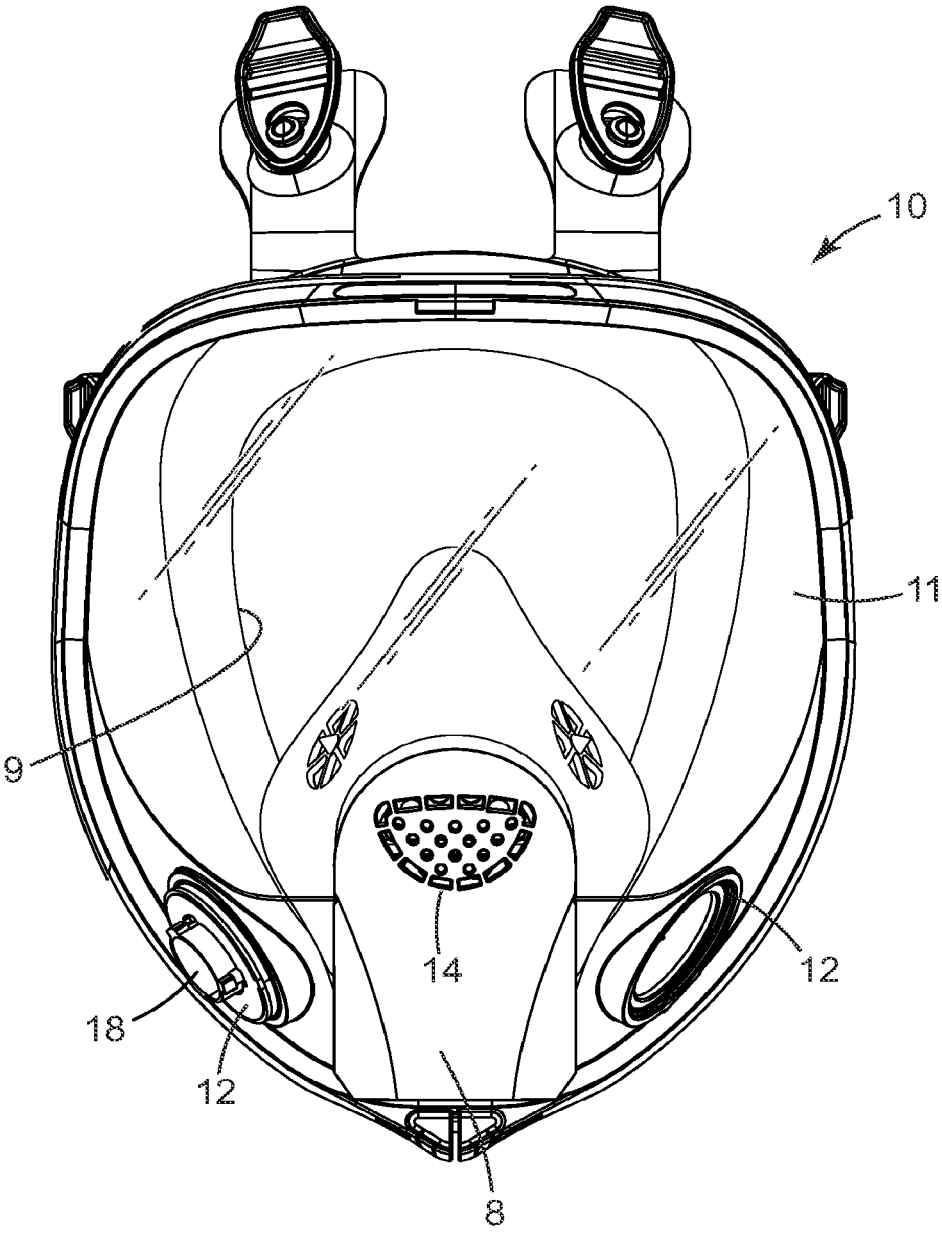
FIG. 1 is a perspective view of an illustrative full face respirator.

In the following description, reference is made to the accompanying drawings that form a part hereof, and in which are shown by way of illustration several specific embodiments. It is to be understood that other embodiments are contemplated and may be made without departing from the scope or spirit of the present invention. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

The term "respirator" means a personal respiratory protection device that is worn by a person to filter air before the air enters the person's respiratory system. This term includes full face respirators, half mask respirators, supplied air hoods, powered air purifying respirators, and self contained breathing apparatus.

The phrase "full face respirator" means a respirator that is worn over a person's nose, mouth, and eyes.

The present disclosure relates to a respirator attachment component and particularly to a respirator attachment component with a molded thermoset elastomeric seal. This disclosure further relates to a respirator that includes a respirator attachment component with a molded thermoset elastomeric seal. This molded thermoset elastomeric seal is chemically bonded to at least one or two surfaces of the attachment component. In many embodiments, the silicone seal element penetrates through the respirator attachment component body. These respirator attachment components have a robust bond between the silicone seal element and the polymeric rigid attachment component. While the present invention is not so limited, an appreciation of various aspects of the invention will be gained through a discussion of the examples provided below.

The respirator attachment component overmolded thermoset elastomeric seal provides a sealing element that is integrally bonded with the attachment component body. This construction has been found to enhance the durability of the seal and prevent debris from being interposed between the attachment component body and the thermoset elastomeric seal. This integral construction also reduces the number of assembly parts and part size variability. The overmolded thermoset elastomeric seal materials described herein also do not require that the attachment component body be primed in order for the thermoset elastomeric seal to be chemically attached to the attachment component body.

Figure 2:
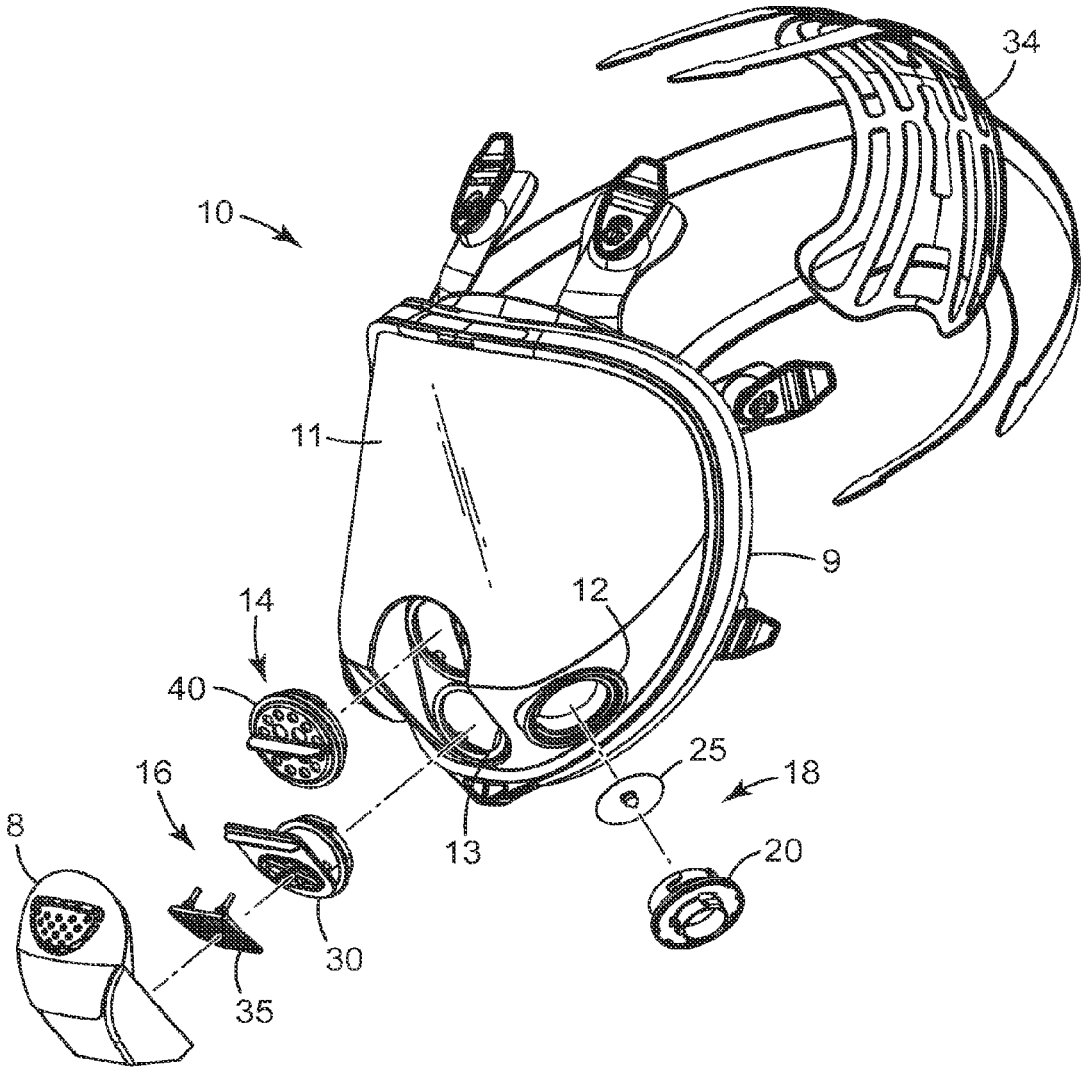
FIG. 2 is an exploded perspective view of an illustrative full face respirator.

FIG. 1 is a perspective view of an illustrative full face respirator 10. FIG. 2 is an exploded perspective view of the illustrative full face respirator 10. This respiratory protection mask 10 includes a polymeric rigid facepicce body 11, face shield 11, or lens 11 attached to a number of respirator attachment components including, for example, one or more inhalation valves 18 with an optional chemical or particulate filtration cartridge (not shown) connected to one or more of the inhalation valves 18, one or more exhalation valves 16, one or more speaking diaphragms 14, and/or one or more headstraps or straps 34 configured to secure the respirator 10 to a user's head. A valve cover 8 is disposed over the exhalation valves 16 and speaking diaphragm 14.

The respirator 10 includes a compliant face contacting member 9 that is compliantly fashioned to allow the respirator body or face shield 11 to be comfortably supported over a person's nose and mouth. The illustrated respirator 10 includes two cheek openings 12 and two nasal openings 13. FIG. 1 illustrates two cheek openings 12 where one cheek opening does not contain a respirator attachment component and one cheek opening includes an inhalation valve 18. FIG. 2 illustrates an inhalation valve 18 in cheek opening 12.

Respirator attachment components 14, 16, and 18 are disposed within or fixed to the openings 12 and 13 by any useful method such as, for example, a bayonet attachment system. A bayonet attachment system is configured for attaching two portions together, where the two portions include elements other than mainly threads such that the two portions are attached by inserting one portion at least partially within the other portion and rotating one portion relative to the other portion so that the two portions can be joined without multiple turns.

While FIG. 1 and FIG. 2 illustrate a respiratory protection mask 10 having one or two cheek inhalation valves 18, and a nasal exhalation valve 16, and a nasal speaking diaphragm 14, any useful respiratory protection configuration is possible. For example, the respiratory protection mask 10 can have a single inhalation valve attached to a chemical or particulate filtration cartridge or clean air supply, and one or two exhalation valves or one or more speaking diaphragms, as desired.

Figure 3:
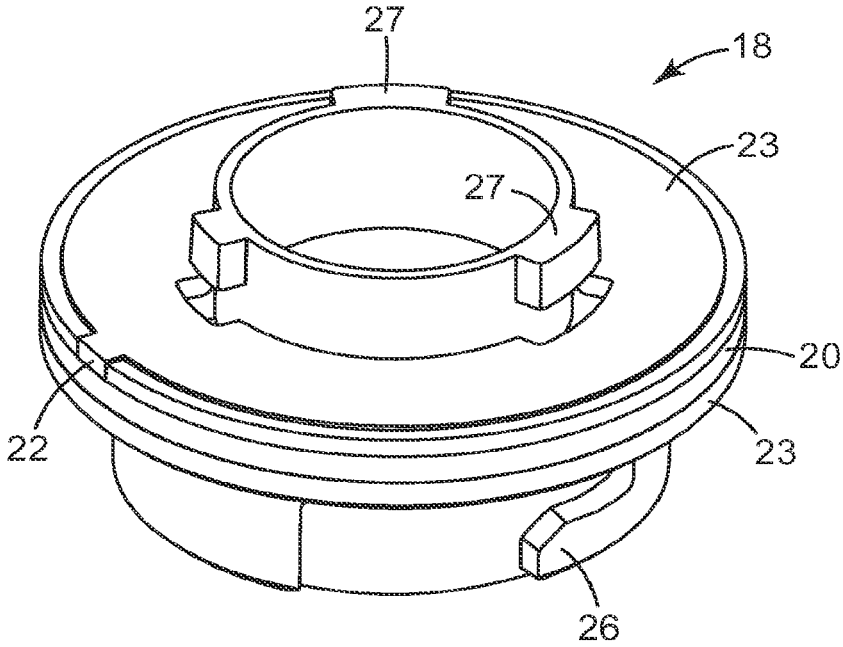
FIG. 3 is a perspective view of an respirator attachment component.
Figure 4:
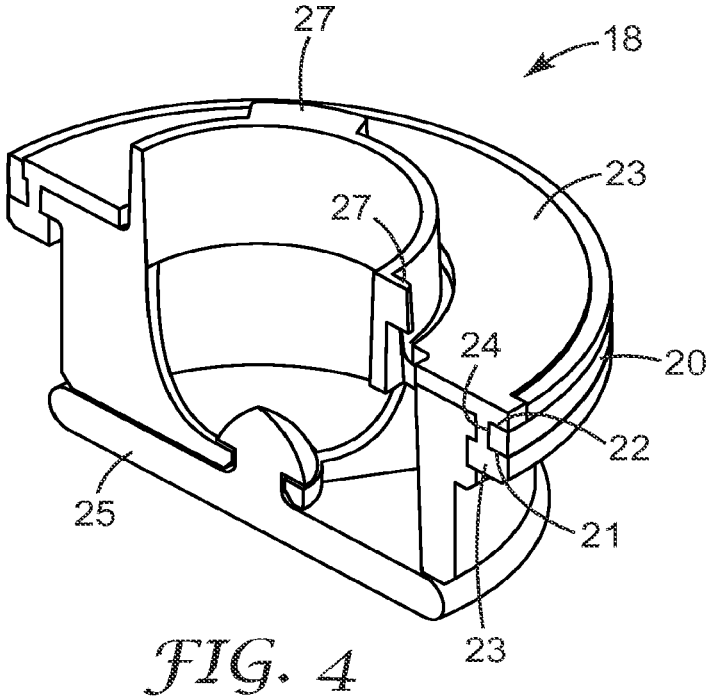
FIG. 4 is a cross-section perspective view of the respirator attachment component illustrated in FIG. 3.

FIG. 3 is a perspective view of an illustrative inhalation valve 18 and FIG. 4 is a cross-section perspective view of the illustrative inhalation valve 18 illustrated in FIG. 3. The inhalation valve 18 includes a polymeric rigid respirator attachment body portion 20 having a first surface 21 and a second surface 22. A silicone sealing element 23 is chemically bonded to the first surface 21 and the second surface 22.

The silicone sealing element 23 can be formed by overmolding a thermosetting silicone material onto a thermoplastic polymeric rigid respirator attachment body portion 20. The thermosetting silicone material chemically bonds (i.e., adhesive bonding or covalent bonding) directly onto to the thermoplastic polymeric rigid respirator attachment body portion 20 first surface 21 and the second surface 22.

The terms "chemical bonding or chemically bonded" refer to physical processes responsible for the attractive interactions between atoms and molecules and includes covalent and ionic bonds, as well as hydrogen and van der Waal's bonds and can often depend on available functional groups on the polymeric rigid respirator attachment body portion surface and their reactivity with the thermosetting silicone material. In many embodiments, the thermosetting silicone material is selected so that pretreatment of the thermoplastic polymeric rigid respirator attachment body portion is not necessary. In other words, the thermosetting silicone material is self-adhesive with the thermoplastic polymeric rigid respirator attachment body portion. The thermosetting silicone material is often heated to cure the thermosetting silicone material during the overmolding process to a temperature sufficient to cure the thermosetting silicone material but less than a glass transition temperature of the thermoplastic polymeric rigid respirator attachment body portion.

As shown in the Examples below, the level of chemical bonding can be determined by the average force to failure test method. In many embodiments, the average force to failure is 25 N or greater, 50 N or greater, or 100 N or greater, or 150 N or greater, or 200 N or greater, or 300 N or greater.

The thermoplastic polymeric rigid respirator attachment body portion 20 can be formed of any useful thermoplastic material. In many embodiments, the thermoplastic polymeric rigid respirator attachment body portion 20 is formed of a polyamide (e.g., nylon), a polycarbonate, polybutyleneterephthalate, polyphenyl oxide, polyphthalamide, or mixtures thereof.

Any useful thermosetting liquid silicone rubber or material can be utilized to form the silicone sealing element 23. Liquid silicone rubber is a high purity platinum cured silicone with low compression set, great stability and ability to resist extreme temperatures of heat and cold. Due to the thermosetting nature of the material, liquid silicone injection molding often requires special treatment, such as intensive distributive mixing, while maintaining the material cool before it is pushed into the heated cavity and vulcanized. Silicone rubber is a family of thermoset elastomerics that have a backbone of alternating silicone and oxygen atoms and methyl or vinyl side groups. Silicone rubbers maintain their mechanical properties over a wide range of temperatures and the presence of methyl-groups in silicone rubbers makes these materials hydrophobic.

Illustrative thermosetting silicone material includes self-adhesive liquid silicone rubbers available under the trade designation: ELASTOSIL LR 3070 from Wacker-Silicones, Munich, Germany; the KE2095 or KE2009 series (such as, for example, KE2095-60, KE2095-50, KE2095-40) or X-34-1547A/B, X-34-1625A/B, X-34-1625A/B all from Shin-Etsu Chemical Co., LTD., Japan. These self-adhesive liquid silicone rubbers do not require pretreatment of certain thermoplastic surfaces for the liquid silicone rubbers to chemically bond to the thermoplastic surface.

In the illustrated embodiment, the first surface 21 and second surface 22 are opposing major surfaces. One or more apertures 24 extend through the respirator attachment component body thickness defined between the opposing first surface 21 and second surface 22. During the overmolding manufacture of the respirator attachment component, liquid silicone (that forms the silicone sealing element 23) flows through the one or more apertures 24 and forms a mechanical interlock between the silicone sealing element 23 and the rigid respirator attachment body portion 20.

A diaphragm 25 can be fixed to the respirator attachment body portion 20. This diaphragm 25 is biased against the respirator attachment body portion 20 to allow unidirectional air flow through the respirator attachment body portion 20.

The respirator attachment body portion 20 can also include a bayonet attachment element 26. The bayonet attachment element 26 assists in fastening the respirator attachment body portion 20 to the cheek opening 12 of the respiratory protection mask 10. The bayonet attachment element 26 mates with a complementary element within or adjacent to the cheek opening 12 of the respiratory protection mask 10. This bayonet attachment system secures the illustrated inhalation valve 18 to the cheek opening 12 of the respiratory protection mask 10.

When assembled, the silicone sealing element 23 of the illustrated inhalation valve 18 is disposed between the first surface 21 and the adjacent cheek opening 12 surface, forming an air-tight seal at the sealing element surface and cheek opening surface interface. The term "air-tight seal" refers to a connection that substantially prevents unfiltered or ambient air from entering an interior portion of the respiratory protection composite facepiece 11 at the connection interface.

Air-tightness is measured with a vacuum leak test. The test fixture consists of a sealed chamber with three ports. The volume of the chamber is approximately 750 $cm^3$. A respirator attachment component is affixed to one of the three ports by means of its bayonet attachment element. A vacuum gauge capable of measuring the pressure differential between the inside of the chamber and the ambient air (to at least 25 cm water) is attached to a second port on the fixture. A vacuum source is attached to the third port through a shut off valve. To conduct the test, the shut-off valve is opened and the vacuum source is turned on to evacuate the chamber to a pressure of 25 cm water below atmospheric pressure (as indicated by the vacuum gauge). The shut-off valve is then closed and the vacuum source is turned off. The vacuum level inside the chamber is monitored for 60 seconds. Inward leakage of air causes the pressure inside the chamber to increase, thereby reducing the vacuum level. For the current disclosure, the pressure differential between the chamber and the ambient air is greater than 15 cm of water after 60 seconds. More preferably, the pressure differential remains above 24 cm of water after 60 seconds.

The silicone sealing element 23 of the illustrated inhalation valve 18 is also disposed between the second surface 22 and an attached filtered air source element (not shown). The filtered air source element can be a chemical or particulate filtration cartridge or a clean air supply source. The filtered air source element can be attached to the illustrated inhalation valve 18 via a bayonet attachment element 27 on the respirator attachment body portion 20. This bayonet attachment element 27 mates with a complementary element on the filtered air source element. Thus, the silicone sealing element 23 of the illustrated inhalation valve 18 forms an air-tight seal at the sealing element surface and filtered air source element interface.

Figure 5:
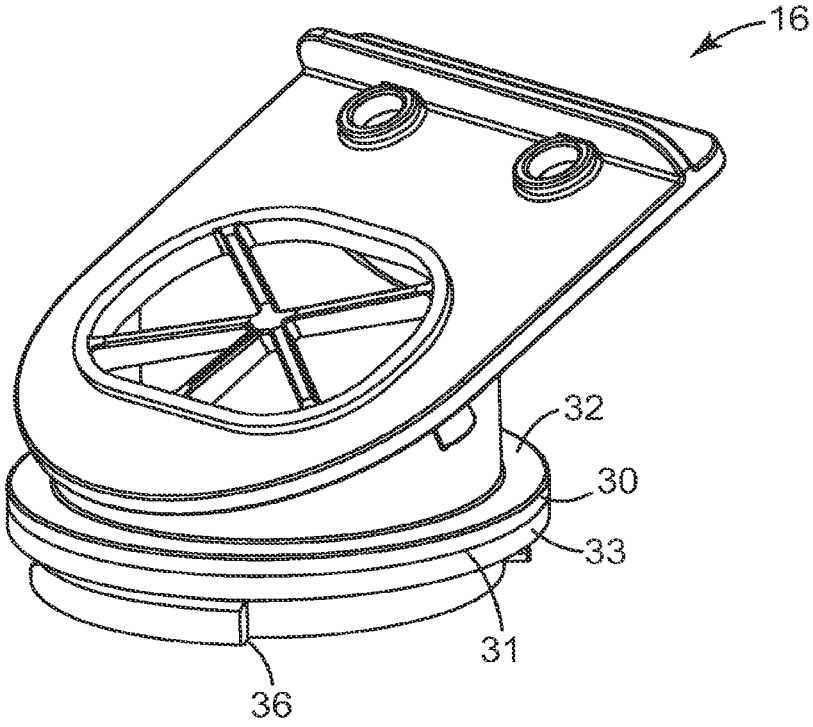
FIG. 5 is a perspective view of an respirator attachment component.
Figure 6:
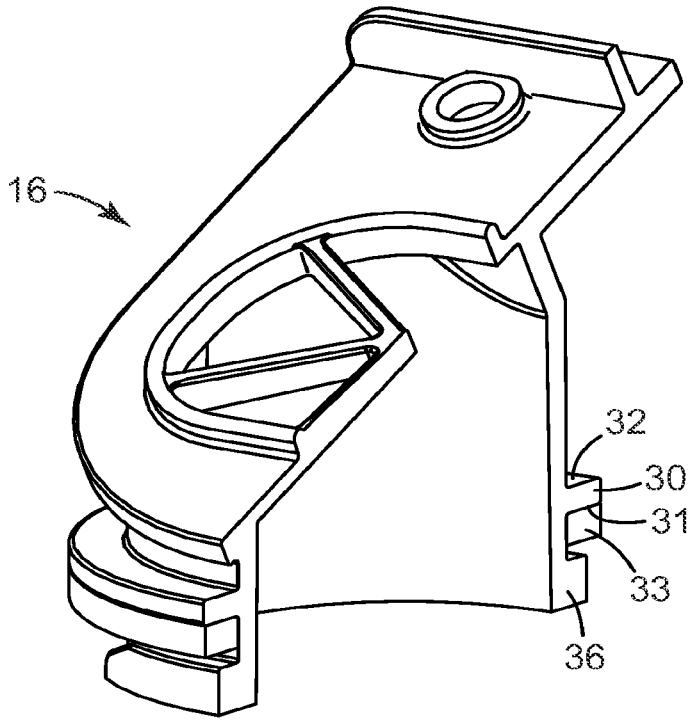
FIG. 6 is a cross-section perspective view of the respirator attachment component illustrated in FIG. 5.

FIG. 5 is a perspective view of an illustrative exhalation valve 16 without showing the diaphragm 35 (shown in FIG. 2). FIG. 6 is a cross-section perspective view of the exhalation valve 16 illustrated in FIG. 5. The exhalation valve 16 includes a polymeric rigid respirator attachment body portion 30 having a first surface 31 and a second surface 32. A silicone sealing element 33 is chemically bonded to the first surface 31.

The silicone sealing element 33 can be formed by overmolding a thermosetting silicone material onto a thermoplastic polymeric rigid respirator attachment body portion 30. The thermosetting silicone material chemically bonds (i.e., adhesive bonding or covalent bonding) directly onto to the thermoplastic polymeric rigid respirator attachment body portion 30 first surface 31. The terms "chemical bonding or chemically bonded" are described above.

The thermoplastic polymeric rigid respirator attachment body portion 30 can be formed of any useful thermoplastic material, as described above. Any useful thermosetting liquid silicone rubber or material can be utilized to form the silicone sealing element 33, as described above.

In the illustrated embodiment, the first surface 31 and second surface 32 are opposing major surfaces. In some embodiments, one or more apertures (not shown) extend through the respirator attachment component body thickness defined between the opposing first surface 31 and second surface 32. During the overmolding manufacture of the respirator attachment component, liquid silicone (that forms the silicone sealing element) flows through the one or more apertures and forms a mechanical interlock between the silicone sealing element and the rigid respirator attachment body portion.

A diaphragm 35 can be fixed to the respirator attachment body portion 30 (see FIG. 2). This diaphragm 35 is biased against the respirator attachment body portion 30 to allow unidirectional air flow through the respirator attachment body portion 30.

The respirator attachment body portion 30 can also include a bayonet attachment element 36. The bayonet attachment element 36 assists in fastening the respirator attachment body portion 30 to the nasal opening 13 of the respiratory protection mask 10. The bayonet attachment element 36 mates with a complementary element within or adjacent to the nasal opening 13 of the respiratory protection mask 10. This bayonet attachment system secures the illustrated exhalation valve 16 to the nasal opening 13 of the respiratory protection mask 10.

When assembled, the silicone sealing element 33 of the illustrated exhalation valve 16 is disposed between the first surface 31 and the adjacent nasal opening 13 surface, forming an air-tight seal at the sealing element surface and nasal opening surface interface. The term "air-tight seal" is defined above.

Figure 7:
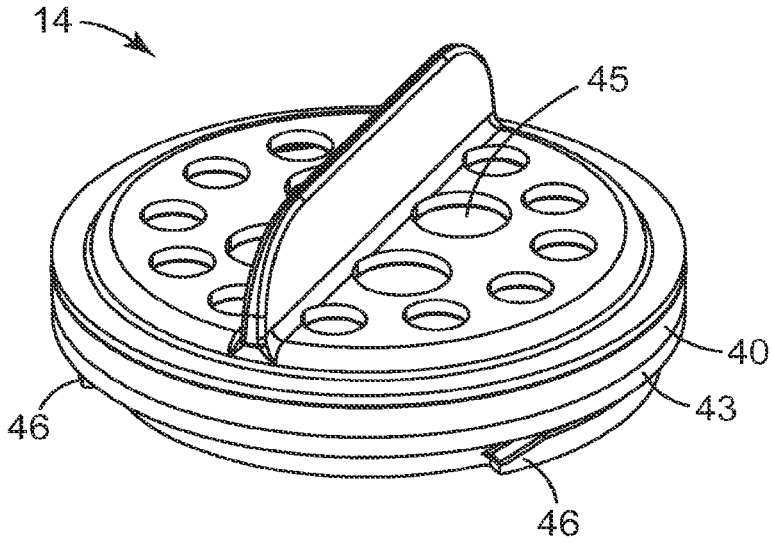
FIG. 7 is a perspective view of an respirator attachment component.
Figure 8:
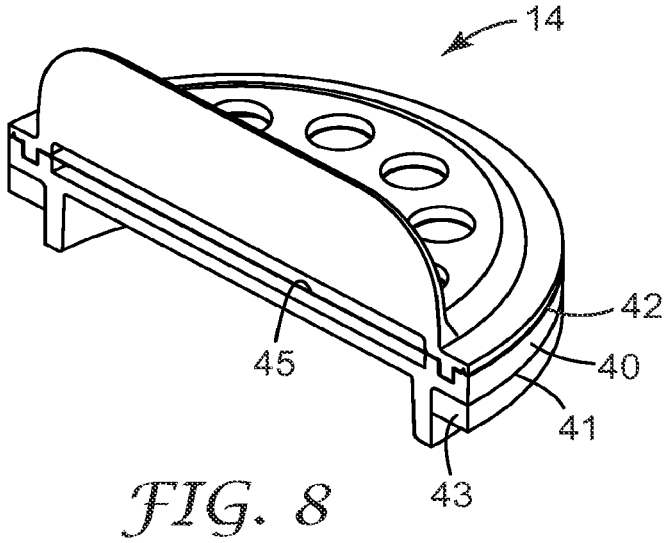
FIG. 8 is a cross-section perspective view of the respirator attachment component illustrated in FIG. 7.

FIG. 7 is a perspective view of an illustrative speaking diaphragm 14, and FIG. 8 is a cross-section perspective view of the speaking diaphragm 14 illustrated in FIG. 7. The speaking diaphragm 14 includes a polymeric rigid respirator attachment body portion 40 having a first surface 41 and a second surface 42. A silicone sealing element 43 is chemically bonded to the first surface 41. A diaphragm 45 is fixed to the polymeric rigid respirator attachment body portion 40. The diaphragm 45 assists in the transmission of sound from a user of the respirator 10 to another person.

The silicone sealing element 43 can be formed by overmolding a thermosetting silicone material onto a thermoplastic polymeric rigid respirator attachment body portion 40. The thermosetting silicone material chemically bonds (i.e., adhesive bonding or covalent bonding) directly onto to the thermoplastic polymeric rigid respirator attachment body portion 40 first surface 41. The terms "chemical bonding or chemically bonded" are described above.

The thermoplastic polymeric rigid respirator attachment body portion 40 can be formed of any useful thermoplastic material, as described above. Any useful thermosetting liquid silicone rubber or material can be utilized to form the silicone sealing element 43, as described above.

In the illustrated embodiment, the first surface 41 and second surface 42 are opposing major surfaces. In some embodiments, one or more apertures (not shown) extend through the respirator attachment component body thickness defined between the opposing first surface 41 and second surface 42. During the overmolding manufacture of the respirator attachment component, liquid silicone (that forms the silicone sealing element) flows through the one or more apertures and forms a mechanical interlock between the silicone sealing element and the rigid respirator attachment body portion.

The respirator attachment body portion 40 can also include a bayonet attachment element 46. The bayonet attachment element 46 assists in fastening the respirator attachment body portion 40 to the nasal opening 13 of the respiratory protection mask 10. The bayonet attachment element 46 mates with a complementary element within or adjacent to the nasal opening 13 of the respiratory protection mask 10. This bayonet attachment system secures the illustrated speaking diaphragm 14 to the nasal opening 13 of the respiratory protection mask 10.

When assembled, the silicone sealing element 43 of the illustrated speaking diaphragm 14 is disposed between the first surface 41 and the adjacent nasal opening 13 surface, forming an air-tight seal at the sealing element surface and nasal opening surface interface. The term "air-tight seal" is defined above.

Examples

Several tests were used to identify suitable combinations of silicone rubbers and thermoplastic materials. Of particular interest is the strength of the bond between the silicone rubber and thermoplastic material, which affects the durability of the air-tight seal.

A surrogate test strip was developed to permit measurement of the bond strength. The test strip is prepared by molding a rigid, flat substrate piece 51 mm long, 25 mm wide, and 2 mm thick with thermoplastic material. The substrate is then clamped into a second mold such that 6 mm of one end of the substrate protrudes into the cavity of the second mold. The cavity of the second mold is 27 mm wide and 49 mm long. The depth of the mold is 2 mm, expanding to 4 mm in the immediate vicinity of the protruding substrate end, such that when silicone is injected into the mold cavity it forms a layer 1 mm thick on all sides of the protruding substrate end. The resulting test strip is thus 94 mm long, with a rigid thermoplastic substrate piece on one end and silicone rubber on the other end.

The strength of the bond between the substrate material and silicone is measured by gripping the two ends of the test strip in the jaws of a mechanical tester such as an MTS Model 858 Material Test System (MTS Systems Corporation, Eden Prairie, Minn.), stretching it until the test strip breaks apart, and recording the force at which failure occurs. Examples of the force to failure are shown in Table 1. Examples 1 through 4 show that bond strengths greater than 300 N can be achieved with the appropriate combination of materials. For Comparative Examples C1 and C2, the silicone did not bond to the thermoplastic material.

| Example | Silicone | Thermoplastic Substrate | Average Force to Failure (N) |
|---|---|---|---|
| 1 | Shin-Etsu KE2095-60 | RTP Nylon 6/6 | 136 |
| 2 | Wacker 3070-60 | RTP Nylon 6/6 | 303 |
| 3 | Dow LC-70-2004 | Zytel PA | 174 |
| 4 | Wacker 3070-60 | Zytel PA | 166 |
| C1 | Dow LC-70-2004 | RTP Nylon 6/6 | No bonding |
| C2 | Shin-Etsu KE2095-60 | Zytel PA | No bonding |

Dow LC-70-2004 silicone is produced by Dow Corning Corporation, Midland MI;
RTP Nylon 6/6 is a polyamide produced by RTP Company, Winona, MN;
Zytel PA is a polyamide produced by E.I. du Pont de Nemours, Wilmington, DE.

Thus, embodiments of the RESPIRATOR ATTACHMENT COMPONENT WITH MOLDED THERMOSET ELASTOMERIC SEAL are disclosed. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A respirator attachment component comprising:

a polymeric rigid respirator attachment body portion having a first surface and a second surface; and a silicone sealing element chemically bonded to the first or second surface;

wherein the polymeric rigid respirator attachment body portion comprises a thermoplastic polymer and the silicone sealing element is a thermoset polymer and the thermoset polymer chemically bonds directly onto the thermoplastic polymer.

2. A respirator attachment component according to claim 1, wherein the silicone sealing element is chemically bonded to the first surface and the second surface.

3. A respirator attachment component according to claim 1, wherein the first surface and the second surface are opposing major surfaces separated by a body portion thickness.

4. A respirator attachment component according to claim 1, wherein the polymeric rigid respirator attachment body portion comprises at least one aperture extending through the polymeric rigid respirator attachment body portion and the silicone sealing element interpenetrates the aperture.

5. A respirator attachment component according to claim 1, wherein the polymeric rigid respirator attachment body portion comprises a plurality of apertures extending through the polymeric rigid respirator attachment body portion and the silicone sealing element interpenetrates the apertures and is chemically bonded to the first surface and the second surface.

6. A respirator attachment component according to claim 1, wherein the polymeric rigid respirator attachment body portion comprises a port extending through the body portion and a plurality of apertures extend through the body portion and disposed about the port, and the silicone sealing element is disposed about the port and interpenetrates the plurality of apertures.

7. A respirator attachment component according to claim 6, further comprising a chemical or particulate filtration cartridge attached to the respirator attachment component.

8. A respirator attachment component according to claim 1, further comprising a diaphragm attached to the polymeric rigid respirator attachment body portion and forming an inhalation valve, an exhalation valve, or a speaking diaphragm.

9. A respirator attachment component comprising:

a polymeric rigid respirator attachment body portion having a first major surface and an opposing second major surface separated by a body portion thickness and a plurality of apertures extending through the polymeric rigid respirator attachment body portion;

a silicone sealing element chemically bonded to the first major surface and second major surface and interpenetrates the apertures; and a diaphragm attached to the polymeric rigid respirator attachment body portion and forming an inhalation valve.

10. A respiratory protection mask comprising:

a polymeric rigid facepiece body portion; and a compliant face contacting member attached to the polymeric rigid facepiece body portion; and respirator attachment component fixed to the polymeric rigid facepiece body portion the respirator attachment component comprising:

a polymeric rigid respirator attachment body portion having an attachment surface; and a silicone sealing element chemically bonded to the attachment surface.

11. A respiratory protection mask according to claim 10, wherein the respirator attachment component is removably attached to the polymeric rigid facepiece body portion.

12. A respiratory protection mask according to claim 10, wherein the respirator attachment component further comprises a second surface opposing the attachment surface and the silicone sealing element is chemically bonded to both the attachment surface and the second surface.

13. A respiratory protection mask according to claim 10, wherein the attachment surface and the second surface are opposing major surfaces separated by a body portion thickness.

14. A respiratory protection mask according to claim 10, wherein the polymeric rigid respirator attachment body portion comprises at least one aperture extending through the polymeric rigid respirator attachment body portion and the silicone sealing element interpenetrates the aperture.

15. A respiratory protection mask according to claim 10, wherein the polymeric rigid respirator attachment body portion comprises a plurality of apertures extending through the polymeric rigid respirator attachment body portion and the silicone sealing element interpenetrates the apertures.

16. A respiratory protection mask according to claim 10, wherein the polymeric rigid respirator attachment body portion comprises a port extending through the body portion and a plurality of apertures extend through the body portion and disposed about the port, and the silicone sealing element is disposed about the port and interpenetrates the plurality of apertures and a diaphragm is attached to the respirator attachment body portion.

17. A respiratory protection mask according to claim 10, further comprising a chemical or particulate filtration cartridge attached to the polymeric rigid respirator attachment body portion.

18. A respiratory protection mask according to claim 10, wherein the respiratory protection mask further comprises a speaking diaphragm attached to the polymeric rigid facepiece body portion.

* * * * *

UNITED STATES PATENT AND TRADEMARK OFFICE

CERTIFICATE OF CORRECTION

PATENT NO. : 8,839,788 B2
APPLICATION NO. : 12/673585
DATED : September 23, 2014
INVENTOR(S) : James Betz It is certified that error appears in the above-identified patent and that said Letters Patent is hereby corrected as shown below:

Title Page, Column 2
Line 1, delete "Silicon" and insert -- Silicone --, therefor.

In The Specification

Column 1
Lines 10-11, delete "Jul. 23, 2008," and insert -- Aug. 31, 2007, --, therefor.

Column 3
Line 42, delete "facepicce" and insert -- facepiece --, therefor.

Signed and Sealed this
Twelfth Day of May, 2015

Michelle K. Lee

Michelle K. Lee
*Director of the United States Patent and Trademark Office*